United States Patent [19]

Koch et al.

[11] 4,011,902

[45] Mar. 15, 1977

[54] DEVICE FOR PRESSURE CASTING

[75] Inventors: Peter Koch, Niederuzwil; Eduard Beyer, Gossau, both of Switzerland

[73] Assignee: Gebruder Buhler AG, Switzerland

[22] Filed: Jan. 15, 1976

[21] Appl. No.: 649,362

Related U.S. Application Data

[62] Division of Ser. No. 511,801, Oct. 3, 1974, Pat. No. 3,964,537.

[30] Foreign Application Priority Data

Oct. 8, 1973 Switzerland ..... 14300/73
May 3, 1975 Switzerland ..... 6026/74

[52] U.S. Cl. ..... 164/314; 164/113
[51] Int. Cl.[2] ..... B22D 17/10
[58] Field of Search ..... 164/113, 119, 120, 133, 164/136, 314, 315, 318, 312

[56] References Cited

UNITED STATES PATENTS

| | | | |
|---|---|---|---|
| 2,484,907 | 10/1949 | Purcell | 164/315 X |
| 2,774,122 | 12/1956 | Hodler | 164/314 |
| 2,893,082 | 7/1959 | Hodler | 164/315 X |
| 3,270,383 | 9/1966 | Holl et al. | 164/120 |
| 3,319,701 | 5/1967 | Eggenberger | 164/315 |
| 3,330,003 | 7/1967 | Eggenberger et al. | 164/315 X |
| 3,344,848 | 10/1967 | Holl et al. | 164/312 |
| 3,349,833 | 10/1967 | Hodler | 164/113 |

*Primary Examiner*—Ronald J. Shore
*Attorney, Agent, or Firm*—McGlew and Tuttle

[57] ABSTRACT

A shot sleeve, for receiving a metered quantity of melt through an inlet or filling opening and connected to the mold cavity, has its volume continuously diminished in such a manner as to maintain a constant communication between the space above the melt in the shot sleeve and the mold cavity for escape of all the gas or air above the melt into the mold cavity before the opening of the shot sleeve into the mold cavity is completely closed by the advancing melt. This is effected, during the shot-pre-filling phase, by an accelerated motion of an injection piston from a rest position, at which the filling inlet to the shot sleeve is open, through the shot sleeve toward the mold cavity opening. As a result of the accelerated motion of the piston, the melt spreads over the melt engaging surface of the injection piston and the formation of a standing wave is prevented. During the mold-filling phase immediately following the pre-filling phase, as soon as the melt surface has reached the casting gate leading to the mold, the metered quantity of melt is displaced through the casting gate into the mold cavity. The mold-filling phase, which follows the pre-filling phase, may be effected in various sequences of motion of the injection piston. The device includes a shot valve controlling the delivery of hydraulic pressure to the injection piston in a preselected manner to provide desired acceleration of the piston in the shot sleeve, and electromagnetically actuated valves, check valves, and chokes are associated with the shot valve to effect a coordinated operation thereof in controlling the movement of the injection piston.

19 Claims, 11 Drawing Figures

DEVICE FOR PRESSURE CASTING

This is a division of application Ser. No. 511,801 filed Oct. 3, 1974, now U.S. Pat. No. 3,964,537.

FIELD AND BACKGROUND OF THE INVENTION

This invention relates to pressure casting, into a mold cavity, a melt quantity metered out in accordance with the volume of the cavity, by diminishing a space, receiving the metered quantity and extending between a casting gate, leading into the mold cavity, and a filling inlet in a two-phase manner including a shot pre-filling phase followed by a mold-filling phase, and to a horizontal cold-chamber die casting machine for performing the method, in which the space receiving the metered quantity of melt is constituted by a shot sleeve and the volume of the shot sleeve is diminished by an injection piston which effects the pre-filling of the shot sleeve and the discharge of the melt into the mold cavity.

At the present time, it is well known, particularly in pressure die casting, to perform the casting process using various steps of motion of the injection piston. Thus, in the course of development, in particular in cold-chamber pressure die casting, two, three, and four-phase systems have come to be known. In particular, the four phase system represents one of the newest which have appeared on the market.

The four casting phases of pressure die casting comprise, subsequently to filling of a metered quantity of the melt to be case at a filling degree between 40 and 80% into the shot sleeve forming the receiving space in which, for example, an injection piston is moved and from which a casting gate leads into the mold cavity (1) moving the injection piston at a very low speed until the filling inlet of the shot sleeve is closed by the piston, (2) then moving the injection piston at a slightly increased, but still low, speed in order to fill the shot sleeve between the injection piston and the casting gate completely with melt, then (3) moving the injection piston at a high speed to fill the mold cavity with melt in a short time, and (4) a fourth phase including a substantially static afterpressure which is exerted on the melt filling out the mold cavity during solidification to compensate solidification shrinkage.

The very low speed during the first phase is important, particularly at high degrees of filling of the shot sleeve forming the space, to avoid spattering of the melt through the filling inlet. In the second phase, the known drawback is that, very frequently, the gas present in the shot sleeve mixes with the melt filled therein, and these gases affect the quality of the casting to be made from the melt. In the third phase, it is known to use different speeds depending on the nature of the melt and the cast piece, and also various technological criteria are taken into account, such as spraying of the casting jet, the cooling velocity of the melt, the danger of cold shots, etc. Recently, it has been found that his modern casting procedure does not always lead to the desired success either, particularly if castings of very high quality are to be manufactured.

SUMMARY OF THE INVENTION

The concept underlying the present invention consists in the provision of filling the shot sleeve with melt in a manner such that, up to the last moment, a gas flow connection is maintained from the diminishing free space, between the melt surface in the shot sleeve and the wall of the sleeve, through the casting gate into the mold cavity. In other words, the residual gas of the melt surface in the shot sleeve must have the opportunity to escape into the mold cavity from which it can be displaced into the overflow ports as well as through the parts of the mold which are permeable for gas.

To realize this basic concept, the invention is characterized in that, during the shot-pre-filling phase, and by an accelerated motion of the injection piston from a rest position at which the filling inlet is open, the space containing the melt is continuously diminished in an accelerated manner and, simultaneously, the metered quantity of melt is gathered toward the casting gate while maintaining the melt continuously spaced from the casting gate, preferably by spreading the quantity of melt over the surface of the injection piston facing the melt to prevent forming of a standing wave, and that, during the mold-filling phase immediately following the pre-filling phase and during which the space is further diminished, as soon as the melt surface has reached the casting gate, the quantity of melt is displaced through the casting gate into the mold cavity.

There are many possibilities of varying the accelerated motion of the injection piston. The mold-filling phase, following the pre-filling phase, also may be carried out in various sequences of motion.

During the accelerated motion of the injection piston, the melt may be spread over still larger portions of the surface area of the injection piston, until the entire surface is covered.

During the pre-filling phase, up to the instant at which the shot sleeve between the injection piston and the casting gate is completely filled with the melt, the accelerated motion may be varied so that a largely unimpeded communication is continuously maintained between the space above the melt surface, in the shot sleeve, and the casting gate.

It is advantageous to move the injection piston, during the pre-filling phase, at an acceleration attaining its operational value without substantially exceeding the same, developing without a substantially sudden decrease, and remaining in the order of magnitude of this operational value. These measures prevent the formation of a preceding wave. A particularly advantageous variant is obtained if, during the pre-filling phase, the injection piston is moved at an acceleration which remains constant after reaching its operational value.

This mode of operation results in (80) numerous advantages. Thus, there may be chosen an operational value of acceleration avoiding a spattering at the filling inlet but permitting, at the same time, to obtain a relatively short duration of the pre-filling phase and thereby preventing the melt from cooling down. Since the acceleration does not decrease, the melt is prevented from breaking away from the injection piston, which would favor the propagation of a preceding wave. Due to the more quiet filling of the shot sleeve, the filling inlet remains open during a proportionally much longer part of the pre-filling phase. Therefore, the time for the air escape is longer than in the known systems even though, owing to the invention, the duration of the pre-filling phase can be equal to or less than the time hitherto usual. Thus, the more quiet filling of the shot sleeve permits a better deaeration because no waves prevent the gases in the upper part of the shot sleeve from passing through. The obtained castings have a better surface, a higher specific weight and a more regular structure. The reject rate is lower than hitherto. It is also possible to maintain the acceleration, during the prefilling phase, without a decrease.

To fully utilize the advantages, the duration of the pre-filling phase should be at least 70% of the total duration of the pre-filling and mold-filling phases. Otherwise, there is a risk of switching over to the mold-filling phse before the prefilling phase is terminated. It is advisable to keep this ratio at at least 90%.

The invention relates to a pressure die casting machine permitting carrying out the procedure described above in a particularly advantageous manner. There is provided a pressure die casting machine comprising a substantially horizontal shot sleeve leading to the mold cavity, an injection piston movable therein and rigidly connected to the shot piston of a shot-piston-cylinder unit, a pressure accumulator, preferably a multiplier associated with the shot-piston-cylinder unit, means controlling the pressing cycle, and a shot valve provided in a pressure line between the pressure accumulator and the shot-piston-cylinder unit.

Various shot valves have been proposed for such pressure casting machines. Most of them do not permit an accurate continuous increase of the volume passing therethrough and serving to drive the shot piston. Thus, a continuous acceleration of the injection piston is not possible.

There have already been proposed shot valves intended to have, at least partly, a linear stroke-volume characteristic. However, they are very complicated and not necessarily suitable for the rough operational conditions of a pressure diecasting machine. Some of them are servo valves having numerous moving parts and complicated connection conditions. The older constructions, for which they are substituted, were also complicated and had very badly controllable characteristics. Besides, it is common to all of these constructions that they have an indefinable behavior at the moment of opening. In many cases, the pressures acting on the valve body are built-up or relieved suddenly, if not even changed in direction. The result is an instability causing an uncontrollable acceleration of the shot piston. This acceleration increases sharply far above its operational value and then suddenly drops. The phenomenon may recur several times until the acceleration attains the operational value. Preceding waves are thereby produced in the melt and the latter breaks away from the injection piston so that the inventive process cannot be carried out.

The presure casting machine in accordance with the invention makes it possible to avoid the drawback mentioned in the foregoing. The shot valve used in this machine is simple and has a small number of parts. The machine is characterized in that the shot valve includes a valve body which is pressed against a valve seat, this valve seat being located between a passage chamber and a connection bore, that the shot valve comprises at least one pressure chamber for pressing the valve body against the valve seat, which chamber, for pressure relief, is connectable through a volume governor to the pressure fluid tank, that the shot valve comprises at least one stroke chamber which can be or is brought under pressure, that the valve body carries a volume-control body projecting into the connection bore and having a diameter decreasing in the direction of the connection bore, so that the volume-control body is connected to the valve body through a cylindrical surface which is short relative to the stroke and which, along with the connection bore, forms a seal.

Due to the seal at the cylindrical surface, the valve body is accelerated to its preselected velocity without permitting pressure fluid to pass through the shot valve. Thus, irregularities occurring in the acceleration of the valve body have no effect on the shot piston. It is only after the valve body has reached its preselected velocity that the flow of the pressure fluid past the volume-control body commences. At that time no jerky movements of the valve body are to be expected, so that the shot piston is accelerated as desired. The pre-filling phase, as from the instant of its start, is thereby slightly prolonged which, however, is of no relevance in view of the improvement of the shot cycle.

In accordance with a development of the invention, the limiting surface of the volume-control body produced by providing a decreasing diameter has to correspond to a linear increase of the volume passing therethrough as a function of the valve body stroke. Thereby, a constant acceleration of the shot body is obtained. To this end, the limiting surface of the volume-control body may be a paraboloid of revolution. If the transition from the paraboloid of revolution to the cylindrical surface is a continuous connection curve, the acceleration, after the cylindrical surface is lifted from the valve seat, will increase progressively, which is a further security against the occurrence of acceleration peaks.

In most cases, an adjustable stroke stop for the opening stroke of the valve body is provided. Thereby, the maximum flow volume and, consequently, the maximum velocity of the shot piston, can be adjusted in a very simple manner. The adjustment of the acceleration of the shot piston is also simple. It is sufficient to adjust the volume governor through which the pressure chamber can be relieved. The velocity of the valve piston is thereby determined.

It is thus made possible to fill the shot sleeve with melt with as little turbulence as possible, without forming a looping advance wave and while keeping the communication path through the casting gate to the mold cavity clear for the escaping gases up to the border of the casting gate.

The motion can be uninterruptedly extended to the complete opening stroke determined by an adjustable stop, which results in a mold filling at an increasing shot velocity.

In many cases, however, it will be necessary to fill the mold cavity at a constant speed. For this purpose, the dynamic pressure in the mentioned pressure chambers of the valve housing can be relieved in an advantageous manner by short-circuiting the volume governor with the aid of simple valve arrangements. Constant shot velocities may thereby be obtained, the value of which is adjustable by the positioning of the stop for the stroke.

In a particularly simple embodiment of the invention, the shot valve is designed with a relatively short valve body and a piston, which latter is formed on the end of the valve body remote from the valve seat by a single change of diameter and which subdivides the valve housing into only two pressure chambers. Aside from volume governor, only three controlled check valves are necessary for carrying out the pressing cycle with a motion sequence in accordance with the invention. By providing a relief of the dynamic pressure which is built up in the rear pressure chamber due to the pressure exerted against the annular surface of the piston facing the valve seat, into the space in front of the paraboidal valve body at the discharge of one shot, the expense of the hydraulic arrangement can be reduced. After a completed shot, the valve closes automatically so that any measures in this direction are superfluous.

By combining the shot valves of the first and second embodiments of the invention, another shot valve for a preferred, third design variant may be obtained. In this case, due to a manner of control or operation of the shot valve for performing the casting similar to that in the second embodiment, the piston formed on the valve body and separating the two middle pressure chambers from each other can be used for an important additional function. Being put under pressure in the closing direction of the shot valve by means of switching valves, this piston can effect a rapid closing of the shot valve. Thereby, the shot valve becomes capable of acting as a check valve for a multiplier which, for reasons of accessibility, is structurally separated from the shot sleeve.

Only modest extra expense for switch valves are necessary in this case, in addition to those of the second embodiment. If appropriate valves are chosen, the arrangement is able to handle large quantities of pressure fluid per time unit.

In using a remote-controlled drive for both the positioning of the stop limiting the valve stroke and the adjustment of the resistance in the volume governor, the device in accordance with the invention becomes suitable for being mounted in programmable pressure casting machines equipped with a centralized control.

An object of the invention is to provide an improved device for pressure casting, particularly die casting.

A further object of the invention is to provide such a device with which a better deaeration of the melt is obtained.

Yet another object of the invention is to provide such a device in which a higher degree of filling of the shot sleeve is made possible so that the diameter of the sleeve can be made similar with a higher specific pressure being exerted on the melt.

A further object of the invention is to provide such a device providing castings with a better surface, a higher specific weight and a more regular structure, as well as a lower rejection rate.

For an understanding of the principles of the invention, reference is made to the following description of typical embodiments thereof as illustrated in the accompanying drawings.

DESCRIPTION OF PREFERRED EMBOIMENTS

The underlying concept of the invention will first be explained with relation to the distance-time diagram of FIG. 9, after which the various embodiments of the apparatus of the invention will be described with reference to the other figures.

While, up to the present time, it has been usual to control the individual velocities in a multi-phase pressure casting process either as a function of the injection piston travel and/or the casting pressure acting thereon, or as a function of the variation in time of the filling operation, the present invention utilizes a different control procedure. In view of the objective of the present invention of maintaining the entire quantity of melt, filled into the shot sleeve, free of gas, and accummulated toward the casting gate up to the application of the high-shot velocity for the filling properly of the mold cavity, a different time-distance program for the injection piston travel must be used, as shown in FIG. 9. Prior to the complete filling of the space between the injection piston and the casting gate of the shot sleeve leading to the mold cavity, the velocity of the injection piston must be so chosen that, starting from the volume of the shot sleeve which, at the rearmost rest position of the injection piston, is initially filled only to 40 – 80% with the metered quantity of melt, a constant unimpeded communication is insured between a volume of residual gas above the level of the metered quantity of melt and the casting gate leading into the mold cavity, during the displacement of the melt for a 100% filling of the space.

Figure 9:
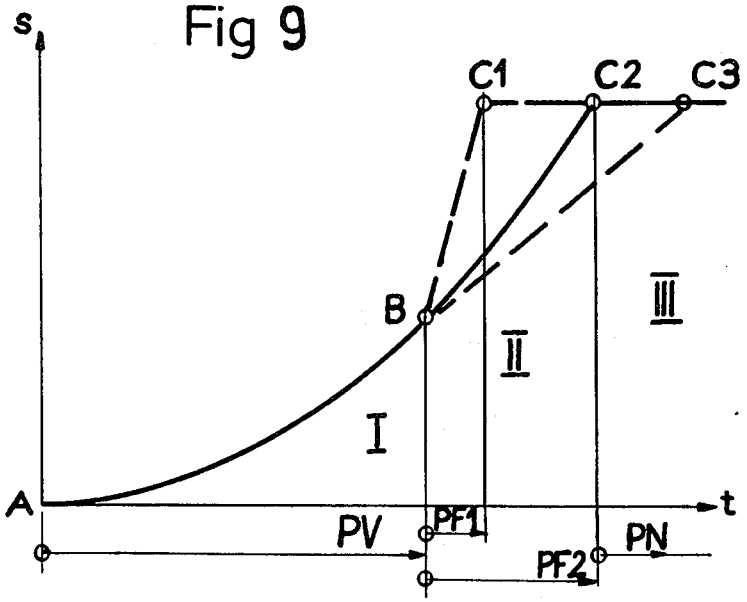
FIG. 9 is a distance-time diagram explanatory of the underlying concept of the invention.

To comply with this condition, it is possible, as a first procedure, to move the injection piston in an accelerated manner, or to diminish continuously the space receiving the metered quantity of melt in an accelerated manner, as indicated at PV in FIG. 9. Thereby, the result is obtained that, due to the inertia of the metered quantity of melt, the melt is dammed and spread over the surface area of the injection piston, or of any other acting force, and, in addition, no wave is generated in the melt volume in advance of the piston and which would be moved toward the casting gate. Such a wave would result in a premature closing of the casting gate, preventing a displacement of the gas, remaining in the shot sleeve above the metered quantity of melt. To avoid the generation of such an advance wave of melt, the acceleration of the member, such as the injection piston, diminishing the volume of the space, is adjustable to the properties of the melt.

The complete filling with melt of the shot sleeve, during the application of the first phase (I) of the pressure casting process, is a substantial precondition for the manufacture of high quality castings made of a melt which does not contain any gas cavities and hardly any oxidation inclusions, since such a filling of the shot sleeve is effected with very little turbulence and without overturning the melt surface.

The following shot operation proper PF is also of importance for the quality of the pressure cast pieces to be manufactured. In particular, the properly chosen transition from the shot-sleeve-filling phase A-B to the shot phase B-C influences the quality of the castings. Experience has shown that it is advantageous to operate the shot phase immediately, without a stoppage time. An operation which has proved particularly advantageous in many cases consists in a logical continuation of the acceleration parabola used for the filling of the shot sleeve and indicated at B-C2 or PF2.

In some cases, however, it may be more advantageous if, starting from the point where the melt has reached the casting gate leading to the mold cavity, there is used, for the mold-filling phase PF and velocity which is different from the instantaneous velocity at this point, as has a constant or time-programmed value B-C1 or B-C3.

The end of the mold-filling phase is manifested primarily by a sharply increasing pressure within the hydraulic fluid acting on the injection piston. At this instant of completed filling of the mold, an additional after-pressure is supplied, both in the predetermined time sequence and as to the pressure built-up, having a compensating effect on the solidification shrinkage.

This pressure casting procedure, which is represented in FIG. 9 with a horizontal time axis and a vertical distance axis, and comprises a first phase I of continuous accelerated motion for filling the shot sleeve with the metered quantity of metal PV, a second, immediately following mold-filling phase II (PF) which is also accelerated or develops at a constant higher or lower velocity than at the instant of termination of the first, pre-filling phase and, as far as necessary, a third after-pressure phase III (PN) increasing to a maximum pressure value, has, above all, considerable advantages as to the quality of the cast pieces. Gas cavities are largely eliminated, turbulences during the prefilling phase PV are practically absent, the control of the piston velocity is substantially facilitated, and there are practically no discrete switching points to be adjusted along the path of travel of the injection piston. The use of continuous motions during the casting operation also results in lower shock stresses in the cold hydraulic system.

One variant for performing the described method consists in a particular design of the shot sleeve constituting the space for receiving the metered quantity of melt. This sleeve is so designed that, at the dimminution of the space and the rising of the melt level resulting therefrom, the extension of the melt surface in a direction traverse to the travel direction of the injection piston effecting the dimminution of the space is maintained constant, or increased, but it is not decreased. While simultaneously complying with this variant-condition and using an accelerated motion of the member diminishing the space receiving the metered quantity of melt, the formation of an advance wave and, thereby, a premature closing of the casting gate, is advantageously prevented in addition. This is due to the fact that, in spite of the accelerated motion of a member acting on the melt, the melt surface cannot overturn nor can the surface of the melt be reduced with the result of a double acceleration of at least the marginal portions of the melt, which would lead to a lateral overturning of the melt and, consequently, to inclusions of gas therein. Thus, substantial improvements in the quality of the pressure casting can be obtained also with this second variant.

Referring now more particularly to FIGS. 1 through 6, a shot sleeve 2 receiving an injection piston 3 is mounted in a stationary mold holding plate 1 of a horizontal cold-chamber pressure die casting machine. Injection piston 3 is rigidly coupled, by means of a piston rod 31, to the shot piston 41 of a shot-piston-cylinder unit 4 which, along with a multiplier-piston-cylinder unit 5 mounted upstream thereof, forms a hydraulic drive. A pressure or piston accumulator 6 which, on the one side, is connected to a pressure gas tank 7, communicates, on the other side, through a pressure line 9 with the multiplier inlet.

The central bore 52 of the multiplier piston 51 accommodates a check valve 53 through which the accumulator pressure is applied to the shot piston 41 for carrying out the pressure casting operation. Since the multiplier-piston-cylinder unit 5 operates in a well known manner, only the connections 27 and 28 for relieving the associated pressure chambers before the shot piston 41 and the multiplier piston 51 at the pressure casting operation are represented for better understanding.

A shot valve 10, for controlling the flow of the pressure fluid from the pressure accumulator 6 through the multiplier 5 to the shot sleeve 4, is mounted in the pressure line 9. Shot valve 10 comprises a valve housing 19 including four separate chambers, of mutually equal diameters, and a valve body 11. A front chamber 14 receives the valve seat 12 as well as the end portion of shot valve body 11, which is conformable to valve seat 12 and designed with a geometrical shape according to FIG. 2. The branch of pressure line 9 which comes from pressure accumulator 6 terminates in a connection 91 provided in the front end of valve body 11, while the branch of line 9 leading to multiplier 5 leaves chamber 14 at a connection 92.

A piston 18 formed in the middle zone of the valve body 11 separates two further pressure chambers 15 and 16 from each other. Each of the latter is provided with a connection 21 and 22, respectively, through which pressure can be applied to piston 18.

Valve body 11 projects into a rear pressure chamber 17 so that pressure can be applied also to the rear end surface 20 of body 11 through a connection 23 provided therein. A threaded screw is provided in the rear wall of pressure chamber 17 as an adjustable stop 24 limiting the opening stroke of shot valve 10.

For controlling the pressure in the pressure chambers 15, 16, 17, and thereby the motion of valve body 11 during the pressure casting operation, connections 21, 22, 23 of the chambers are connected in the following manner. Connection 21 of pressure chamber 15 communicates with the outlet B of an electromagnetically actuated four-way valve 81. Connections 22 and 23 of pressure chambers 16 and 17 are conjointly connected to the outlet A of the same four-way valve 81, through a parallel connection of a check valve 82 and a temperature and pressure compensated volume governor 83. The inlets P and T of four-way valve 81 are connected to corresponding lines 25 and 26, respectively leading from the pressure source P and to the pressure fluid tank T. Neither pressure source P nor pressure fluid tank T are shown in the drawing.

The interconnected, adjacent connections 22 and 23 are further connected, through a precontrolled two-way valve 84, to line 26. A second electromagnetically actuated four-way valve 85 which, at its inlet side, also communicates with the lines 25 and 26, is associated with the control inlet of two-way valve 84 for precontrolling the same.

Figure 2:
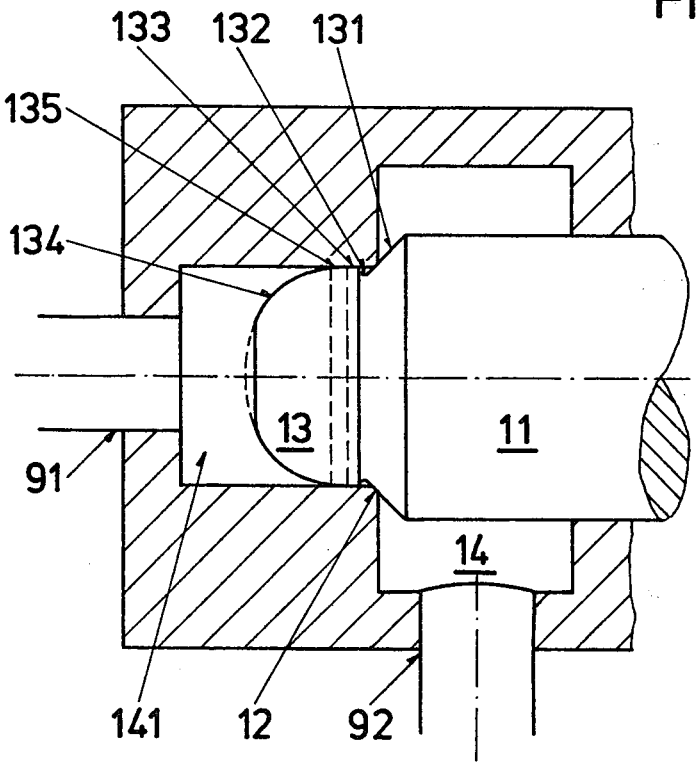
FIG. 2 is an enlarged sectional view illustrating a detail of the valve body.

FIG. 2 shows the end of valve body 11, which is designed as a volume-control body 13. A conical surface 131, cooperating with valve seat 12 and provided on the end of valve body 11 located in front chamber 14, is followed, after a neck 132, by a short cylindrical section 133. The latter is followed first by a slightly longer transition section having the shape of a spherical zone 135 and then by a truncated paraboloid of revolution 134. The intersection lines of the three last-named bodies 133, 134, 135 are indicated in broken lines. In the closed position of shot valve 10, paraboloid of revolution 134 is positioned in a connection bore 141 which receives connection 91 and is subjected to pressure, and the cylindrical surface of section 133 is applied to connection bore 141 in a sealing contact. Connection bore 141 serves as stroke chamber.

Figure 1:
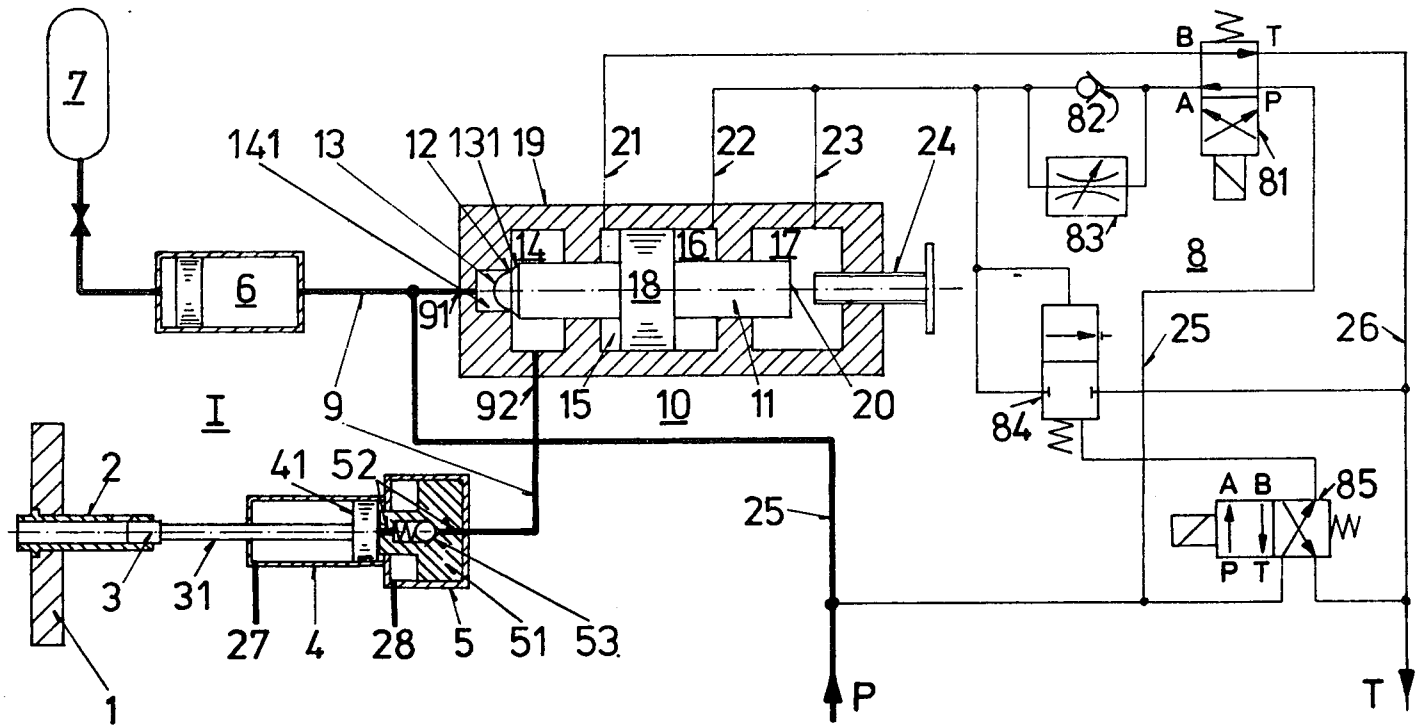
FIG. 1 is a diagrammatic representation of the pressure part of a horizontal cold-chamber pressure die casting machine, illustrating the scheme of operation of a first embodiment of a device in accordance with the invention.

The device shown in FIG. 1 permits the following operations. In the closed position of shot valve 10, the two four-way valves 81 and 85 as well as two-way valve 84 are in their switching positions shown in FIG. 1. Consequently, pressure chamber 15 is relieved toward pressure fluid tank T while the two pressure chambers 16 and 17 are under the system pressure through check valve 82. The system pressure is substantially tially equal to the pressure in charged pressure accumulator 6 which, through connection 91 of pressure line 9, is effective against volume-control body 13 in stroke chamber 141. The pressure of pressure source P is permanently applied to connection 91.

The rear end surface 20 of valve body 11, in pressure chamber 17, and the annular surface of piston 18, in pressure chamber 16, have a total area, subjected to pressure in the closing direction, larger than the total area of volume-control body 13, subjected to pressure in the opening direction. By the resulting closing force, valve body 11 is pressed against valve seat 12.

Figure 3A:
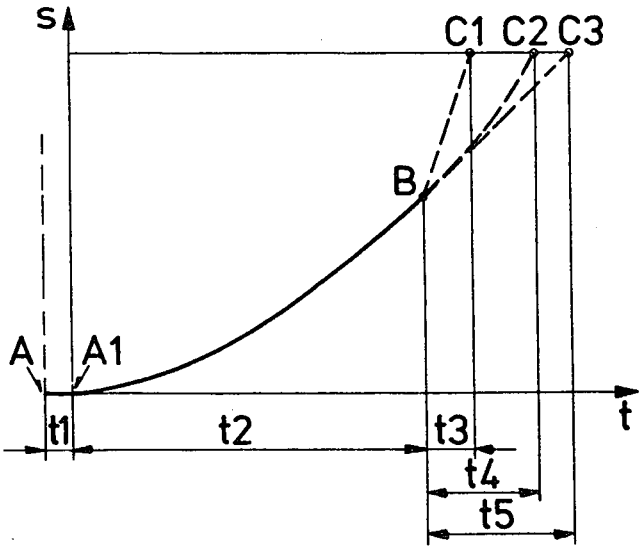
FIG. 3A is a distance-time diagram of the shot piston motion.
Figure 3B:
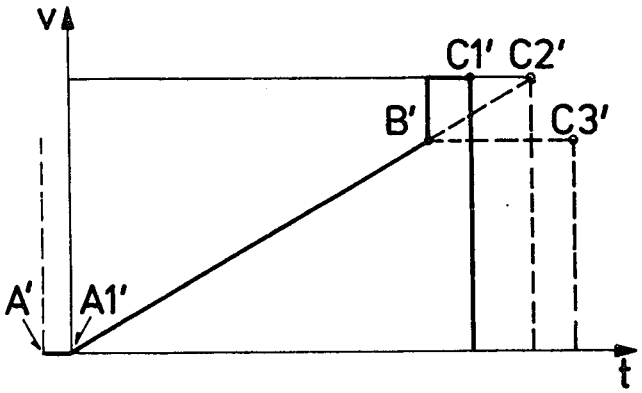
FIG. 3B is a velocity-time of the piston velocity.
Figure 3C:
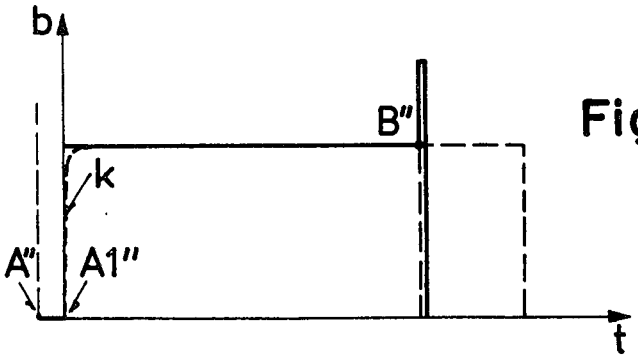
FIG. 3C is an acceleration-time diagram of the piston acceleration.

For opening the shot valve, in which operation valve body 11 has to perform its partial stroke corresponding to an accelerated filling of shot sleeve 2 at a uniform velocity, four-way valve 81 is switched over. This has the effect that, on the one hand, pressure chamber 15, acting as a stroke chamber, is subjected to the system pressure and, on the other hand, the two pressure chambers 16 and 17 are connected to pressure fluid tank T through volume governor 83 which is adjusted to a predetermined desired resistance value. Under the effect of the pressure acting on volume-control body 13, conical surface 131, and the annular surface of the piston 18 in the stroke chamber 15, the pressure fluid flows, while developing a dynamic pressure, at a constant velocity corresponding to the resistance adjusted in choke 83, into pressure fluid tank T. The velocity of valve body 11 is then also uniform. At the same time, volume-control body 13, which is moved relative to valve seat 12 at a constant velocity, clears, for the pressure fluid flowing to shot sleeve 4, a sectional area of flow which becomes enlarged in conformity with the curvature of its surface illustrated in FIG. 2. The variation in time of the injection piston travel $s$, which increases at the same rate as the sectional area of flow between valve seat 12 and volume-control body 13, is shown in the distance-time diagram $s$ $(t)$ of FIG. 3A. The corresponding time diagrams $v(t)$ and $b(t)$ in FIGS. 3B–3C show the variation of the respective velocity $v$ and acceleration $b$.

In the mentioned diagrams $s(t)$, $v(t)$, $b(t)$, the points A, A'. A'' designate the instant $t = 0$ in which the control signal is given by reversing four-way valve 81 to open shot valve 10. A conical surface 131 of valve body 11 is lifted from valve seat 12, the passage first remains closed because of the sealing effect between the cylindrical surface of section 133 and the passage bore 141. Up to point A1, shot piston 3 remains immobile. Actually, the sealing effect between section 133 and connection bore 141 cannot be absolute because the main sealing of shot valve 10 is effective between conical surface 131 and valve seat 12. However, the effect of the very small flow at the motion of section 133 along connection bore 141 is negligible. Thereupon, the end of cylindrical section 133 moves past valve seat 12. To prevent a sudden increase of the acceleration of injection piston 3 at the transistion to the surface of paraboloid of revolution 134, due to the sudden enlargement of the sectional area of flow, spherical zone 135 is provided as an intermediate section between cylindrical surface 133 and paraboloid of revolution 134. The tangent of the spherical zone is first parallel to the wall of connection bore 141, whereby the transition from section 133 to paraboloid of revolution 134 is a continuous curve, so that the effective flow starts only progressively. The effect of the spherical zone is indicated by the broken line $k$ in FIG. 3C. The curve $v(t)$, which is represented as a sloping straight line, should begin with a small, upwardly concave arc and its straight portion would then be very slightly displaced to the right hand side. This time displacement is, however, very small and therefore not represented.

The linearly increasing velocity of shot piston 3 is due the fact that valve body 11 moves at a constant velocity and the volume passing therethrough increases linearly as a function of the stroke of valve body 11. Thus, the acceleration of shot piston 3 remains constant. The injection piston travel $s(t)$ therefore moves up to point B following a parabolic function. The corresponding time is designated t2. This time should be at least 70of the total time of a complete pressure casting cycle, constituted by the pre-filling phase and mold-filling phase together, preferably at least 90%. During the time t1, valve body 11 is thus accelerated to the final value of its velocity. In this time t1, its motion is uncontrolled, even jerky, because of the sudden pressure changes at connection 91 or at volume governor 83. However, since there is practically no passage to shot piston 3, the latter is not affected. It is only after valve body 11 has reached its constant velocity that the passage is cleared within the time t2 and, at the beginning of time t2, first very gently, due to the effect of spherical zone 135.

If a mold-filling phase of constant speed is required, volume governor 83 is short-circuited to the pressure fluid tank, after shot sleeve 2 has been filled up, by reversing two-way valve 84 by means of electromagnetically actuated four-way valve 85. In the absence of the dynamic pressure in pressure chambers 16 and 17, shot valve 10 is suddenly fully opened.

Through the flow passage of constant sectional area thus formed between valve seat 12 and paraboloid of revolution 134, the pressure fluid penetrates at an intreased but constant speed via pressure line 9 and multiplier 5 into shot sleeve 4. Thereupon the shot motion takes place at also constant velocity, the valve of which is dependent on the width of the sectional area of flow between valve seat 12 and paraboloid of revolution 134, which is given by the chosen position of the stop 24.

The travel of the injection piston increases, during a short time t3, sharply but linearly up to the end point C1 of the injection piston stroke. The velocity $v$ jumps to its highest value and remains constant in the time t3 to the full stroke C1, whereupon it drops back to zero. The velocity jump is due to a needle-shaped acceleration pulse occurring in the point B''.

If it is required to carry out the shot at the same constant acceleration as the filling of shot sleeve 2, valve body 11 is allowed to move back up to adjustable stop 24 which has previously been positioned in accordance with the requirements. In this case, the characteristics $s(t)$, $v(t)$ and $b(t)$ have a continuously developed shape up to the completion of the shot (end point C2 for the distance of C2' for the velocity $v$). The respective time t4, of course, is correspondingly longer.

An adjustment of stop 24, such that valve body 11 abuts it at the instant where the injection piston travel $s$ reaches point B, results in a linear development of the injection piston travel progressing tangentially from the parabola and running up to the end point C3 of the injection piston stroke. The time necessary in this case is t5 while the velocity $v$ remains constant up to the corresponding end point c3' and the acceleration $b$ behind point B'' is zero.

The shot valve is closed after each completed shot cycle by setting all the valves 81, 84, 85 back into their initial switching position according to FIG. 1.

Figure 4:
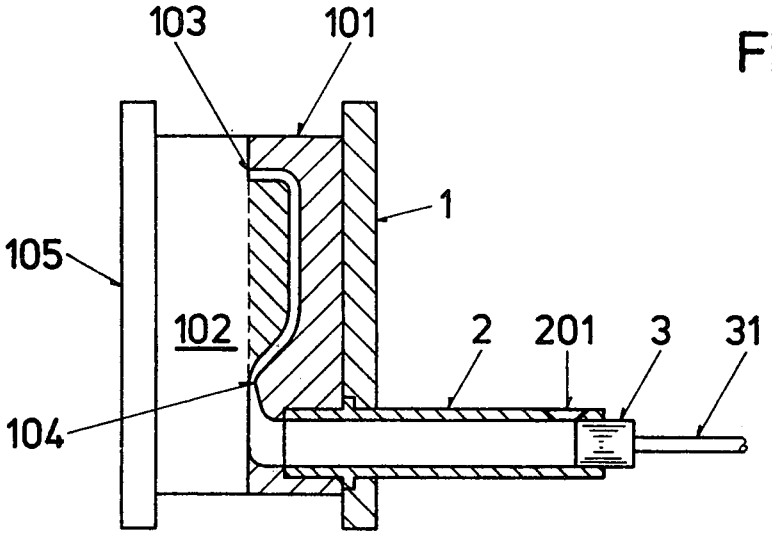
FIG. 4 is an enlarged sectional view illustrating the arrangement of the pressure part relative to the mold cavity.

FIG. 4 illustrates the arrangement of the pressure casting part of a horizontal cold-chamber pressure casting machine Shot sleeve 2, fixed in stationary mold holding plate 1, is provided with a filling inlet 201 for supplying the metal. At the beginning of the pressure casting operation, injection piston 3, displaceable in the shot sleeve, is in its initial position in front of filling inlet 201.

The end of the shot sleeve 2 remote from the filling inlet 201 projects into a mold part 101 secured to stationary mold holding plate 1. Along with a second mold part 102, first mold part 101 forms a mold cavity 103 which communicates with shot sleeve 2 through a casting gate 104.

The second mold part 102 is carried by a mobile mold holding plate 105. Stationary mold holding plate 1, along with mold part 101 mounted thereon, as well as shot sleeve 2, are shown in a sectional view.

The device in accordance with the invention makes it possible, due to the motion sequences of the pressure casting cycle illustrated in FIGS. 3A–3C, to fill the shot sleeve 2 in an accelerated manner (pre-filling phase t2) and subsequently to continuously fill mold cavity 103 at a constant or increasing velocity according to the requirements of the case (mold-filling phase t3, t5, or t4).

An improved quality of the castings is obtained owing to the fact that, in the pre-filling phase t2, no advance wave is formed on the surface of the melt which would break away from injection piston 3 and be reflected on the wall of the sleeve, but the surface of the melt is progressively dammed up toward the zone of casting gate 104 while the turbulence is strongly reduced and a an escape way for the gases from shot sleeve 2 through casting gate 104 into mold cavity 103 is continuously maintained clear during the time t2.

Figure 5:
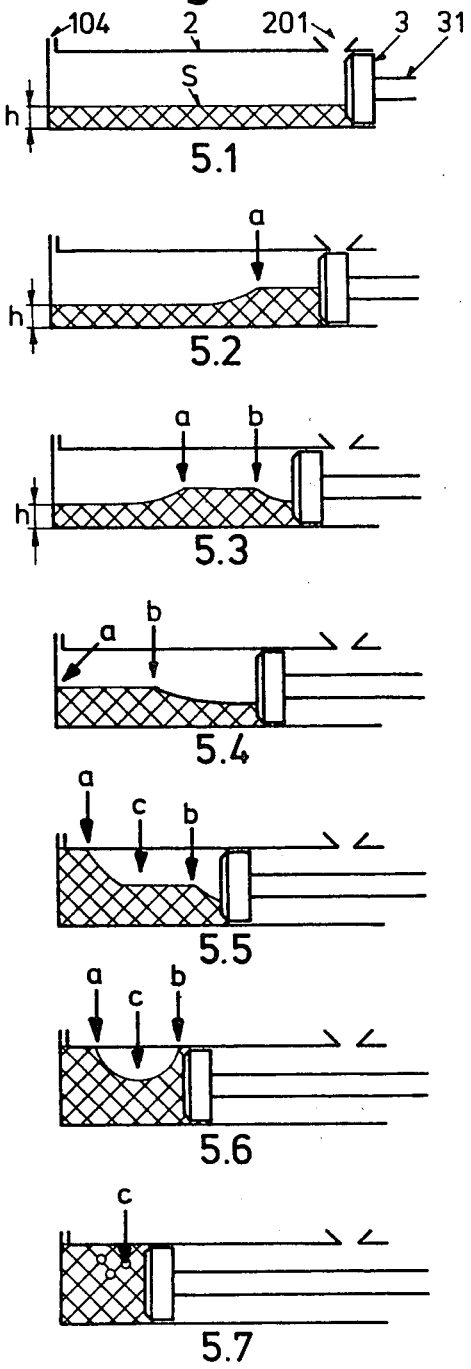
FIG. 5 is a set of diagrams illustrating the filling cycle in a shot sleeve in accordance with the prior art.
Figure 6:
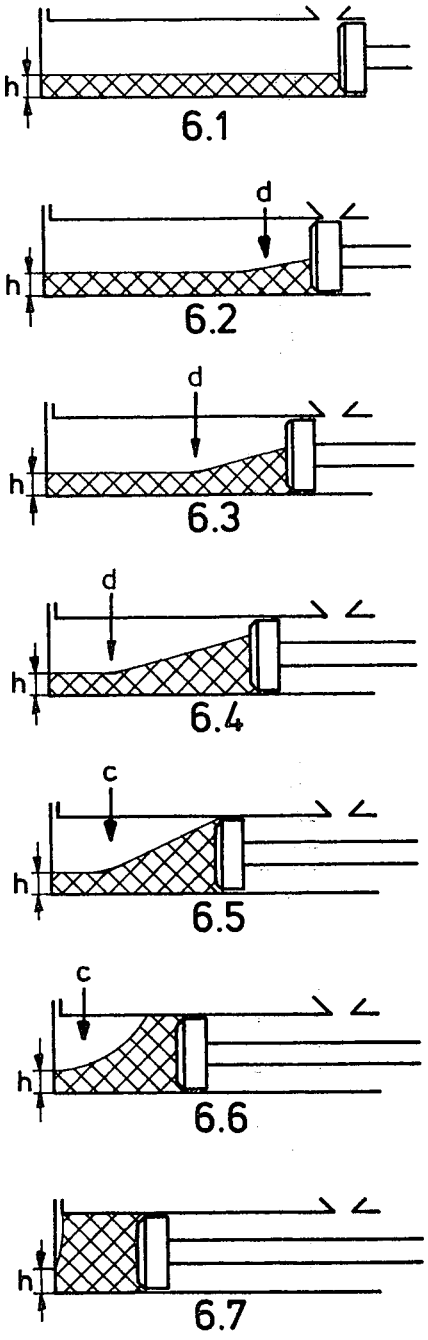
FIG. 6 is a set of diagrams illustrating the filling cycle and the shot sleeve in accordance with the invention.

This procedure which can be carried out in applying the present invention, is illustrated in FIGS. 5 and 6 in comparison with the filling of a shot sleeve 2 as known from the prior art.

FIGS. 5 and 6 show, diagrammatically, shot sleeve 2 with filling inlet 201, casting gate 104 located in the upper zone of shot sleeve 2, as well as injection piston 3 displaceable in shot sleeve 3 and connected to piston rod 31. The metal melt filled in and metered up is designated S.

Each of FIGS. 5 and 6 comprises seven diagrams 5.1 to 5.7 and 6.1 to 6.7, respectively, showing the development of the filling of shot sleeve 2 in a chronological sequence of the characteristic moments of the cycle. The corresponding diagrams of FIGS. 5 and 6 are indicated by the same last numeral, for example 5.1 and 6.1, and relate in each case to the same sequential phase.

In FIG. 5, showing the prior art, the filling is carried out at a constant velocity of the injection piston. In FIG. 6, the piston moves at a constant acceleration in accordance with the invention.

Diagrams 5.1 and 6.1 show the initial state prior to the motion of the injection piston, in which the batch of melt S has a uniform surface level at a height $h$.

In diagrams 5.2 and 6.2, the injection piston is advanced so far that filling inlet 201 is closed. On the surface of melt S in diagram 5.2, the front $a$ of an advance wave becomes notable while in diagram 6.2, at the point $d$, melt S is progressively elevated and becomes spread over the surface area of the piston. In both cases, the level of melt $S$ below casting gate 104 remains at the height $h$.

After a further displacement of injection piston 3, diagram 5.3 shows that an advance wave begins to break away from the piston surface and forms an additional rear front $b$ while melt S in the corresponding diagram 6.3 continues to spread progressively over the piston surface under simultaneous displacement of the point $d$ toward casting gate 104. The melt level below the casting gate both in diagram 5.3 and diagram 6.3 still keeps the height $h$.

In diagram 5.4, the front $a$ of the advance wave has reached the wall of the sleeve in the zone of casting gate 104, while, in diagram 6.4, the level of the melt at the respective point remains unchanged in the height $h$.

Diagram 5.5 shows the abutting wave front $a$ dammed up, reflected and the casting gate already closed. The gas trapped in the space $c$ can no longer escape. On the contrary, according to diagram 6.5, melt S has become spread over the whole area of the piston while the height $h$ of the melt level below casting gate 104 is still unchanged. The escape route for the gas from the space $c$ through casting gate 104 is clear as before.

Due to the further advance of injection piston 3, the enclosed space $c$ filled with gas is more and more reduced, as shown in diagram 5.6 and the trapped gas is compressed. By diminution of the space $c$ in diagram 6.6, on the contrary, the gas is progressively displaced out of shot sleeve 2.

After the filling of shot sleeve 2 at a constant speed of the injection piston has been terminated, the gas shown in diagram 5.7 remains in melt S in the form of small bubble chamber $c$ which strongly affect the quality of the casting.

According to diagram 6.7, on the contrary, the height $h$ of melt S in the sleeve wall below casting gate 104 remains constant up to the termination of the filling operation so that the gate is kept open for the evacuation of the gas. The manufacture of castings without occlusions of gas is thus insured.

Figure 7:
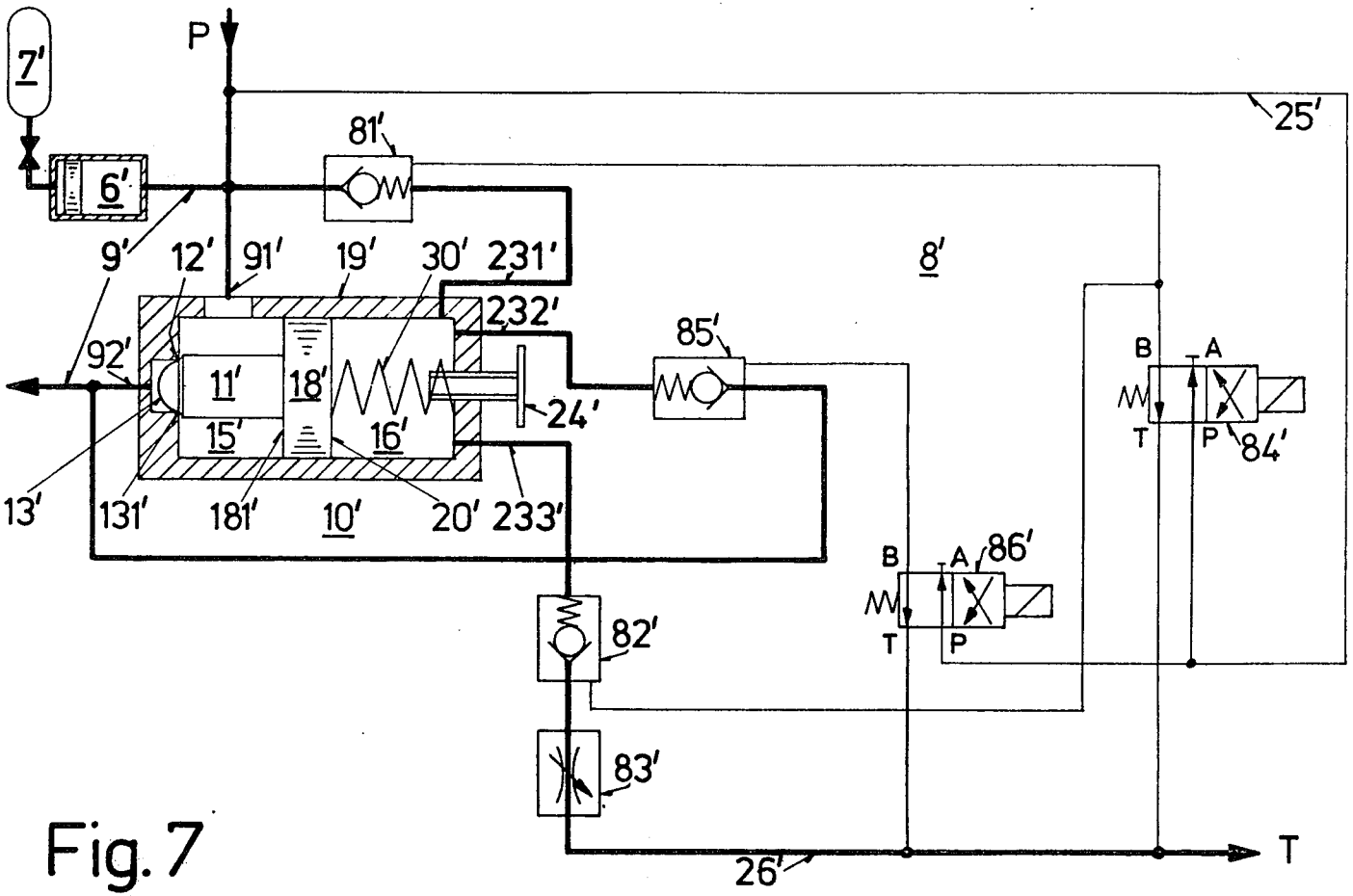
FIG. 7 is a view similar to FIG. 1 illustrating the operational diagram of a second embodiment of the invention.

In the particularly simple embodiment of the invention shown in FIG. 7, the shot valve 10' comprises a relatively short valve body 11' which, at its end remote from the valve seat 12', is formed with an abruptly increased diameter so that this end embodies a piston 18' while the other end of the body, in the zone of the valve seat 12', is formed as a volume-control body 13.

The valve housing 19' comprises two pressure chambers 15', 16' separated from each other by piston 18'. The front pressure chamber 15' accommodates valve body 11', the annular surface 181' of piston 18' adjacent thereto, valve seat 12', volume-control body 13' designed in accordance with FIG. 2 and applying against the valve seat, as well as teo connections 91', 92' of a pressure line 9'. In comparison with FIG. 1, connections 91' and 92' are reversed in their location.

The representation of the pressure casting part connected to pressure line 9' has been omitted in this figure. For clarity, only pressure accumulator 6' and the pressure gas tank 7' are shown. Pressure accumulator 6' is connected through connection 91' to pressure chamber 15' of shot valve 10'.

Rear pressure chamber 16' in the valve housing 19' accommodates a return spring 30' which seats against the back surface 20' of piston 18' and against the rear wall of the housing, an adjustable stop 24' provided in the rear wall of the housing, and three connections 231', 232', 233'.

For controlling shot valve 10', switching elements are associated therewith as follows. A first controlled check valve 81' has its inlet connected to connection 91' and its outlet connected to first connection 231' of the pressure chamber 16'. A second controlled check valve 82' is connected, at its inlet side, to a further connection 233' of pressure chamber 16' and, at its outlet side, through a temperature and pressure compensated volume governor 83', to the line 26' leading to pressure fluid tank T. A first electromagnetically actuated four-way valve 84' has its inlets P and T connected to the corresponding lines 25' and 26' coming from pressure source P and leading to pressure fluid tank T and its outlet B connected to the control inlets of the two check valves 81', 82'. A third controlled check valve 85' has its inlet connected to the third connection 232' of pressure chamber 16' and its outlet connected to connection 92' of the branch of pressure line 9' leading from shot valve 10' to the drive 4, 5 (FIG. 1).

A second electromagnetically actuated four-way valve 86' has its inlets P and T also connected to the corresponding lines 25' and 26' leading from pressure source P and to pressure fluid tank T and has its outlet B connected to the control inlet of third check valve 85'.

The mode of operation of the device shown in FIG. 7 differs from that of the first embodiment of the invention shown in FIG. 1 as will now be described. In the closed position of shot valve 10', in which four-way valves 84', 86' are again in the switching position shown in FIG. 7 so that first check valve 81' is open and the two other check valves 82', 85' are closed, the rear surface 20' of piston 18' is subjected to the system pressure in the closing direction and annular surface 181' of piston 18', as well as the small conical surface 131' of volume control body 13', are subjected to the system pressure in the opening direction. Consequently, due to the force resulting from the surface ratio between the inversely loaded pressure surfaces 20', 13', 131', shot valve 10' is held closed.

An opening of shot valve 10' is obtained by reversing first four-way valve 84'. Thereupon first check valve 81' closes and second check valve 82' opens. Through opened check valve 82' and the constantly adjusted resistance of volume governor 83', pressure chamber 16' becomes connected to line 26' leading to pressure fluid tank T so that a return motion of shot valve 11' at a uniform velocity and, therefore, an accelerated filling of shot sleeve 2 is made possible.

The filling of shot sleeve 2 once terminated, first four-way valve 84' is brought back into its initial switching position and, simultaneously, second four-way valve 86' is also reverted.

Through reopened check valve 81', the accumulator pressure is again applied to connection 231' of pressure chamber 16'. Second check valve 82' closes and the pressure fluid expands from pressure chamber 16' through the also opened third check valve 85' into connection 92' located in the branch of line 9' connecting shot valve 10' to the drive 4, 5, Valve body 11' is suddenly displaced back up to the full opening stroke.

It is evident that pressure chambers 15' and 16' are adapted to function as a lifting and contact-pressure chamber.

After the shot, the pressure in the branch of pressure line 9' between shot valve 10' and drive 4, 5 rises to the value of the accumulator pressure. Since, with shot valve 10' open, the surfaces at both sides of the same are mutually equal, valve body 11' is pressure-balanced. At this moment, return spring 30' closes shot valve 10'.

Before the start of a new cycle, it is sufficient to bring second four-way valve 86' into its initial switching position.

Figure 8:
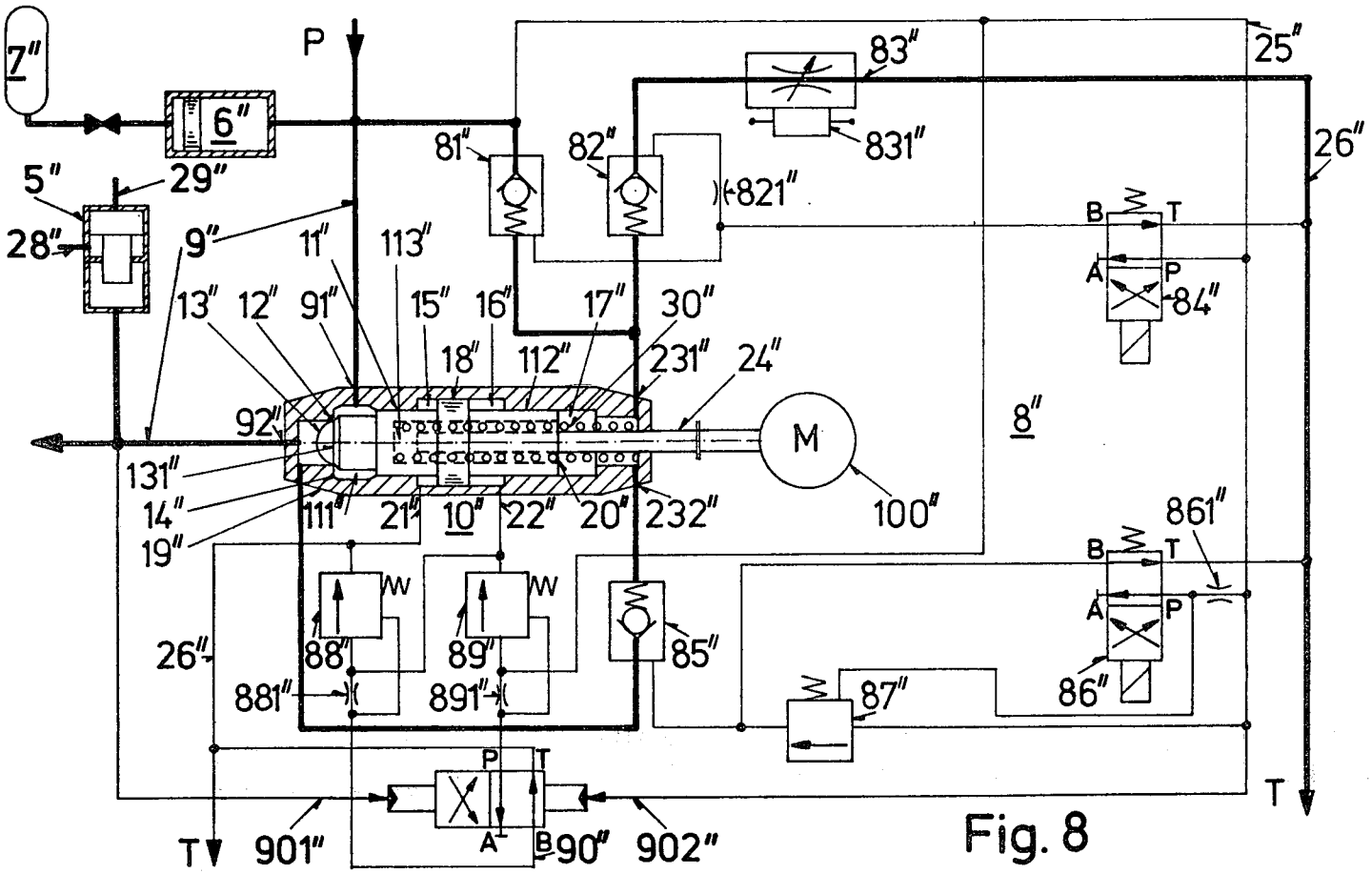
FIG. 8 is a view similar to FIG. 1 illustrating the operational diagram of a third embodiment of the invention.

FIG. 8 shows a third embodiment of the invention in which the shot valve 10'' is designed as a combination of shot valves 10 and 10' according to FIGS. 1 and 7.

A stepped valve body 11'' is received in the valve housing 19'' which is subdivided into four pressure chambers 14'', 15'', 16'', 17''. Front pressure chamber 14'' accommodates the valve seat 12'', and a first portion 111'' of the valve body 11'' having a first diameter and formed with a volume-control body 13'' which is designed in accordance with FIG. 2 and projects into valve seat 12''.

The branch of a pressure line 9'' leading from the pressure accumulator 6'' terminates in front pressure chamber 14'' at a connection 91'' while the branch of line 9'' leading to the drive 4, 5 starts at a connection 92''. This last-named branch of pressure line 9'' is connected to a multiplier 5'' having two control connections 28'', 29'' and mounted separately from shot sleeve 4.

A second portion 112'', having a larger diameter than the first portion 111'' of valve body 11'' and adjacent to the latter, extends through valve housing 19'' from front chamber 14'' into rear chamber 17''. In its middle zone, portion 112'' is formed with a piston 18'' having a third diameter which is larger than the diameter of second portion 112''. Piston 18'' divides a bore of valve housing 19'', having a corresponding diameter, into the two intermediate pressure chambers 15'' and 16'' each of which is provided with a respective connection 21'', 22''.

The interior of second valve body portion 112'' is formed with an axially extending cylindrical cavity 113'' receiving a return spring 30'' seating against the bottom of the cavity and a rod 24'' projecting therein and serving as an adjustable stop. The other end of the return spring 30'' rests against the rear wall of the stapped end portion of rear pressure chamber 17''. The rod serving as adjustable stop 24'' also extends through this rear wall. Stop 24'' is preferably adjusted in its axial position by means of a geared motor 100''. Two connections 231'' and 232'' terminate in the rear pressure chamber 17''. The valve arrangement associated with shot valve 10'' for controlling the pressure casting operation in accordance with the invention, and comprising three controlled check valves 81'', 82'', 85'', a temperature and pressure compensated volume governor 83'' and two four-way valves 84'', 86'' is substantially the same as described in connection with FIG. 7.

An additional switching element in this valve arrangement is a relief valve 87'' for pre-controlling third check valve 85'' because of the large diameters of the connection lines. The inlet or relief valve 87'' is connected to line 25'' leading from pressure source P and its outlet is connected to the control inlet of third check valve 85'' as well as to the outlet B of second four way valve 86''. The inlet P of second four-way valve 86'' is connected to the control inlet of the relief valve 87'' directly and to the line 25'' through a choke 861'' which latter serves as a protection of four-way valve 86''.

In case the arrangement operates with a smaller rate of pressure-fluid flow, relief valve 87'' may be omitted.

In contrast to the volume governors 83 and 83' in FIGS. 1 and 7, the volume governor 83'' of FIG. 8 is equipped with a remote-controlled electric actuating mechanism 831''. A retarding choke 821'' is further provided at the control inlet of second check valve 82'' for preventing pressure shocks in the circuit.

Piston 18'' and the two pressure chambers 15'', 16'' adjacent the same at both sides have a function which differs from that of the corresponding elements 18, 15, 16 in the embodiment of FIG. 1. Shot valve 10'' thereby is made capable of a third function in addition to its two original functions, namely the accelerated filling of the shot sleeve and the rapid shot. That is, shot valve 10'' thereby is adapted to function as a rapidly acting check valve for multiplier 5'' which is constructionally separated from shot sleeve 4.

To this end, the outlets of two further relief valves 88'', 89'' are associated with connections 21'' and 22'' of pressure chambers 15'' and 16''. In addition, the outlet of first relief valve 88'' is connected through line 26'' to pressure fluid tank T, and the outlet of second relief valve 89'' is connected to the inlet of first relief valve 88'' directly and to the control connection of the latter through a first control choke 881''.

The inlet of second relief valve 89'' is connected directly to line 25'' from the pressure source P and, through a second control choke 891'', to the inlet P of a third four-way valve 90'' which is actuated hydraulically.

Outlet B of four-way valve 90'' is connected to the control inlet of first relief valve 88''. One control inlet 901'' of third four-way valve 90'' is connected to the branch of pressure line 9'' leading from connection 92'' to the pressure chamber of the non-represented shot sleeve 4 which is turned to the multiplier, and the other control inlet 902'' of four-way valve 90'' is connected to the branch of the pressure line 9'' leading from pressure accumulator 6'' to connection 91''.

The three relief valves 87'', 88'', 89'' are designed as cartridge valves. They are connected in the circuit so that an initially supplied pressure applies simultaneously to the collar-like small surface formed on the cylindrical body of the valve and to the full cross-section of the valve body, thereby holding the valve closed. To open valves 87'', 88'', 89'', the larger surface of the valve body which is remote from the control connection must be exposed to pressure and, at the same time, the pressure in the control connection must be reduced.

For controlling the pressure casting in accordance with the invention and effecting the same sequential steps, the device illustrated in FIG. 8 can be operated in substantially the same manner as described in connection with FIG. 7. Pressure chambers 14'' and 15'' function in this case as lifting chambers and pressure chamber 17'' acts as a contact pressure chamber.

A remote control of drives 100'' and 831'', for adjusting stop 24'' in shot valve 10'' and the resistance of volume governor 83'', respectively makes it possible to include the pressure casting into the program of centrally controlled pressure die casting machines.

Piston 18'' and the two adjacent pressure chambers 15'', 16'', which are not needed for the control of the pressure casting operation, are relieved, during the opening stroke of valve body 11'' through the respective connections 21'', 22'' toward pressure fluid tank T. For this purpose, during the opening stroke of valve body 11'', hydraulically actuated four-way valve 90'' is in the position shown in FIG. 8. Consequently, second relief valve 89'' is held closed because its control inlet is exposed to the system pressure.

The pressure fluid which, at the opening stroke of valve body 11'' is displaced from pressure chamber 16'' by piston 18'', flows through first choke 881'', third four-way valve 90'' and line 26'' to pressure fluid tank T. Due to the pressure drop at first control choke 881'', first relief valve 88'', and thereby also a passage to pressure chamber 15'' behind piston 18'', are opened.

The relatively weak return spring 30'' would be able, at the pressure compensation at the two ends of the valve body after completion of the shot, to close valve body 11'' only slowly. In order to bring shot valve 10'' rapidly into its closing position, which is its third main function as a check valve for the multiplier, third four-way valve 90'' is reversed by the pressure in shot sleeve 4 which increases relative to the accumulator pressure after the shot has been effected.

Thereby, on the one hand, system pressure is applied to the control inlet of first relief valve 88'' through the cross connection P-B in four-way valve 90'' and valve 88'' is held closed and, on the other hand, a pressure which is somewhat reduced through the two control chokes 881'', 891'' becomes effective at connection 22'' of pressure chamber 16'' and pressure fluid flows into the latter. Due to the pressure which is increased in connection 22'' and the pressure drop through second choke 891'', second relief valve 89'' is opened and system pressure is applied to pressure chamber 16'' as well as to the surface of piston 18'' located therein to rapidly close shot valve 10''. In this case, the pressure chamber 16'' acts as a contact-pressure chamber for the multiplier check valve.

While specific embodiments of the invention have been shown and described in detail to illustrate the application of the principles of the invention, it will be understood that the invention may be embodied otherwise without departing from such principles.

What is claimed is:

1. In a pressure casting machine for casting, into a mold cavity, a melt quantity metered out in accordance with the volume of the cavity, by diminishing a space, receiving the metered quantity and extending between the casting gate, leading into the mold cavity, and a filling inlet in a two-phase manner including a shot pre-filling phase followed by a mold-filling phase, and of the type including a substantially horizontal shot sleeve leading to the mold cavity, an injection piston movable in the shot sleeve and fixedly connected to the shot piston of a shot-piston-cylinder unit, a pressure accumulator, means for controlling the pressure casting cycle, and a shot valve interposed in a fluid pressure line extending between the pressure accumulator and the shot-piston-cylinder unit, the improvement comprising, in combination, a valve seat in said shot valve between a passage chamber and a connection bore in said shot valve; a valve body mounted in said shot valve and cooperable with said valve seat; said shot valve being formed with at least one pressure chamber serving to press the valve body against the valve seat, a pressure fluid receiving tank; a volume governor adapted to connect each pressure chamber to said pressure fluid receiving tank, for relieving the pressure; said shot valve including at least one stroke chamber adapted to be subjected to fluid under pressure; means connecting one of said passage chamber and said connection bore to said pressure accumulator and the other of said passage chamber and said connection bore to said shot-piston-cylinder unit; and a volume-control body connected to said valve body and having a diameter decreasing in the direction of said connection bore and projecting into said connection bore; said volume-control body being connected to said valve body through a cylindrical surface of said volume-control body which cylindrical surface is short relative to the stroke of said valve body and forms, in combination with said connection bore, a sealing.

2. In a pressure casting machine, the improvement claimed in claim 1, including a multiplier associated with said shot-piston-cylinder unit.

3. In a pressure casting machine, the improvement claimed in claim 2, in which said shot valve includes an additional pressure chamber for pressing said valve body against said valve seat to serve as a check valve against the pressure exerted by said multiplier; and a change-over valve subjected to the operational pressure of said machine and connected to said multiplier to put said multiplier into operation.

4. In a pressure casting machine, the improvement claimed in claim 3, in which said shot valve is designed as a combination of a shot valve comprising four pressure chambers and a shot valve comprising two pressure chambers; said combination shot valve including a front pressure chamber comprising said valve seat and a first valve body portion having a first diameter; said front pressure chamber having two connections of said pressure line and being located between said valve seat and the annular shoulder surface of an adjacent second valve body portion having a second diameter which is larger than the diameter of said first valve body portion; said combination shot valve having two further central pressure chambers in its central zone; a piston formed on said second valve body portion and having a third diameter which is larger than the diameter of said second valve body portion, said two central pressure chambers being separated from each other by said piston; each central pressure chamber having a respective connection; said combination shot valve further including a rear pressure chamber having a stepped end portion; and said second valve body portion being displaceable in said rear pressure chamber and having a rear end surface; said rear pressure chamber having two connections providing for the application of pressure to or the relief of pressure from said rear end surface of said second valve body portion; said second valve body portion having an axially extending cylindrical cavity; a return spring engaged in said cavity against the inner end surface thereof and engaged in said stepped portion of said rear pressure chamber; and a rod, serving as a displaceable top, extending through the end wall of said stepped portion and within said return spring toward the inner end of said cylindrical cavity.

5. In a pressure casting machine, the improvement claimed in claim 4, including a remote-control drive operatively associated with said stop to adjust said stop.

6. In a pressure casting machine, the improvement claimed in claim 4, in which said means for controlling the pressure casting cycle comprises first and second controlled check valves; means connecting the outlet of said first controlled check valve and the inlet of said second controlled check valve to a first one of the two inlet connections of said rear pressure chamber; means connecting the inlet of said first controlled check valve to said pressure accumulator; a volume governor connecting the outlet of said second controlled check valve to a line leading to a pressure fluid receiving tank; and electromagnetically actuated first four-way valve having its inlet side connected to said line leading to said pressure fluid receiving tank and to a line leading from a source of fluid under pressure; means connecting said electromagnetically actuated first four-way valve directly to said first check valve and, through a time-delay choke, to said second check valve; said electromagnetically actuated first four-way valve constituting a pilot control for said first and second controlled check valves and effective simultaneously thereon but in mutually opposite directions; first and second relief valves; means connecting the outlet side of said first relief valve to the connection of a first one of said central pressure chambers located nearest said front pressure chamber and to said line leading to said pressure fluid receiving tank; means connecting the inlet side of said first relief valve to the outlet of said second relief valve and to the connection of the other central pressure chamber and through a first control choke to its own control connection; means connecting the inlet side of said second relief valve directly to said line leading from said source of fluid under pressure and, through a second control choke, to its own control connection; a hydraulically actuated second four-way valve operatively associated with the control connections of said first and second relief valves and connected to said line leading to the pressure fluid receiving tank; means connecting a first actuation inlet of said hydraulically actuated second four-way valve to the pressure space of said shot sleeve at the multiplier side; means connecting the other actuation inlet of said hydraulically actuated second four-way valve to said pressure accumulator; a third controlled check valve; means connecting said third controlled check valve to a second one of the connections of said rear pressure chamber; and means interconnecting said third controlled check valve to the outlet connection from said bore in front of said shot valve body to the pressure space of said shot-piston-cylinder unit; said means for controlling the pressure casting cycle further including a valve group; said valve group comprising an electromagnetically actuated second four-way valve; a third relief valve connected to said electromagnetically actuated second four-way valve for pilot control by the latter; means connecting one inlet of said electromagnetically actuated second four-way valve to said line leading to said pressure fluid receiving tank; means connecting the other inlet of said electromagnetically actuated second four-way valve to the control connection of said third relief valve and, through a protection choke, to said line leading from the source of fluid under pressure; means connecting the inlet of said third relief valve directly to said line leading from the source of fluid under pressure; and means connecting the outlets of said electromagnetically actuated second four-way valve and said third relief valve conjointly to the control connection of said third check valve.

7. In a pressure casting machine, the improvement claimed in claim 6, in which said hydraulically actuated second four-way valve is connected directly to said two central pressure chambers so that said first and second relief valves are by-passed; and said second electromagnetically actuated four-way valve is connected directly said third check valve whereby said third relief valve is by-passed.

8. In a pressure casting machine, the improvement claimed in claim 1, in which the limiting surface of said volume-control body, produced by said decreasing diameter, corresponds to a linear increase of the volume flowing past said volume-control body as a function of the stroke of said valve body.

9. In a pressure casting machine, the improvement claimed in claim 8, in which the limiting surface of said volume-control body is a paraboloid of revolution.

10. In a pressure casting machine, the improvement claimed in claim 9, in which the transition surface from said paraboloid of revolution to said cylindrical surface is a continuous connection curve.

11. In a pressure casting machine, the improvement claimed in claim 1, including an adjustable stroke stop in said shot valve limiting the opening stroke of said valve body.

12. In a pressure casting machine, the improvement claimed in claim 1, in which said shot valve includes a valve housing formed with said passage chamber, with said passage chamber surrounding both said valve seat and a first portion of said valve body; two fluid pressure line connections connected to said passage chamber; said valve housing being formed with a bore intermediate its ends; said valve body being formed with a piston disposed in said bore, and said piston separating said bore into two pressure chambers, one on each side of said piston; respective connections associated with each of said two pressure chambers for subjecting said piston to pressure at either side of said piston; said valve body being formed with a rear pressure chamber at its end opposite said passage chamber and said connection bore; said valve body including a second portion received in said rear pressure chamber and having a rear end surface; a separate pressure connection to said rear pressure chamber operable to subject said rear end surface of said valve body to pressure; and an adjustable stop in said rear pressure chamber in the form of a threaded rod threaded through a rear wall of said rear pressure chamber.

13. In a pressure casting machine, the improvement claimed in claim 12, in which said pressure line comprises a branch extending from said pressure accumulator to said shot valve in front of said volume-control body, and a branch connecting said shot-piston-cylinder unit to said passage chamber.

14. In a pressure casting machine, the improvement claimed in claim 12, in which said two pressure chambers constitute central pressure chambers, with one of said central pressure chambers being adjacent said rear pressure chambers; an electromagnetically actuable first four-way valve interposed between the connections to said central and rear pressure chambers and lines leading from a source of fluid under pressure and to said pressure fluid tank; a parallel connection of a check valve and a volume governor connecting the connections of said rear pressure chamber and the adjacent central pressure chamber with that outlet of said electromagnetically actuable first four-way valve acting in the opposite direction relative to that outlet communicating with the connection to the other of said cylindrical chambers; a pre-controlled two-way valve connected between the interconnected connections of said rear pressure chamber and the adjacent central pressure chamber and a line leading to said pressure fluid tank; and an electromagnetically actuable second four-way valve connected to said line leading from said source of fluid under pressure and to said line leading to said pressure fluid tank, and also connected to said two-way valve to pre-control said two-way valve.

15. In a pressure casting machine, the improvement claimed in claim 1, in which that end of said shot valve body remote from said valve set is formed with a piston whose annular surface facing said valve seat limits a front pressure chamber including said valve seat and said valve body; said front chamber having two connections for said pressure line; the rear end surface of said piston, adapted to be exposed to full pressure, limiting a rear pressure chamber; a return spring in said rear pressure chamber engaged with said piston; said rear pressure chamber having three connections selectively operable to exert pressure on said piston end surface or to relieve pressure from said piston end surface.

16. In a pressure casting machine, the improvement claimed in claim 15, in which said pressure line has a branch connected to said pressure accumulator; a first control check valve interposed between said branch and a first one of said three connections to said rear pressure chamber; a volume governor communicating, at its outlet side, with a line leading to a pressure fluid receiving tank; a second controlled check valve mounted between a second one of said three connections to said rear pressure chamber and said adjustable choke; an electromagnetically actuable four-way valve connected to said line leading to said pressure fluid receiving tank and a two-way further line extending from a source of fluid under pressure in advance of said first and second controlled check valves; said electromagnetically actuable four-way valve being connected to said first and second controlled check valves for a conjoint and preliminary control of said first and second controlled check valves; a third controlled check valve interposed between the third one of said three connections to said rear pressure chamber and an outlet connection, from said front pressure chamber, leading to said shot-piston-cylinder unit; and an electromagnetically actuable second four-way valve connected to said line leading to the pressure fluid receiving tank and to said line leading from said source of fluid under pressure, as well as to said third controlled check valve, for pre-controlling said third controlled check valve.

17. In a pressure casting machine, the improvement claimed in claim 15, in which said pressure accumulator is connected to said front pressure chamber and said shot-piston cylinder unit is connected to the outlet from said bore in front of the shot valve body.

18. In a pressure casting machine, the improvement claimed in claim 1, in which said shot valve includes a housing having a rear wall, said valve body being reciprocable in said housing; and an adjustable spindle extending through said rear wall and engageable with said valve body to adjustably limit the opening stroke of said shot valve.

19. In a pressure casting machine, the improvement claimed in claim 1, including a remotely controlled drive operatively associated with said volume governor and operable to adjust the resistance of said volume governor to the required value.

* * * * *